US005383737A

United States Patent [19]

Urion

[11] Patent Number: 5,383,737

[45] Date of Patent: Jan. 24, 1995

[54] HAND WRITING DEVICE

[75] Inventor: Kenard E. Urion, Woodbury, N.J.

[73] Assignee: Graphic Controls Corporation, Buffalo, N.Y.

[21] Appl. No.: 48,778

[22] Filed: Apr. 16, 1993

[51] Int. Cl.[6] ..... B43K 23/00; B43K 29/00

[52] U.S. Cl. ..... 401/48; 401/6

[58] Field of Search ..... 401/6, 48; 15/437

[56] References Cited

U.S. PATENT DOCUMENTS

| | | | |
|---|---|---|---|
| D. 262,462 | 12/1981 | Baker . | |
| 43,242 | 6/1864 | Thompson . | |
| 150,633 | 5/1874 | Tinney | 401/48 |
| 155,996 | 10/1874 | Titus . | |
| 317,309 | 5/1885 | Cox | 401/48 X |
| 338,239 | 3/1886 | Wyche . | |
| 478,787 | 7/1892 | Croom . | |
| 724,687 | 4/1903 | Floren | 401/48 |
| 825,985 | 7/1906 | De Schwertenberg . | |
| 1,197,289 | 9/1916 | Henry . | |
| 1,336,432 | 4/1920 | Henry . | |
| 1,342,576 | 6/1920 | Wride . | |
| 1,411,691 | 4/1922 | George . | |
| 1,669,755 | 5/1928 | Hopper . | |
| 1,818,081 | 8/1931 | Mingos . | |
| 1,840,191 | 1/1932 | Eubanks . | |
| 2,178,755 | 11/1939 | Johnson | 15/437 |
| 2,245,116 | 6/1941 | Rhatigan | 401/48 |
| 2,296,139 | 9/1942 | Blair . | |
| 2,394,452 | 2/1946 | Howard | 401/48 |
| 2,497,418 | 2/1950 | Schroeder, Jr. . | |
| 2,748,474 | 6/1956 | Brown . | |
| 2,785,462 | 3/1957 | Barg . | |
| 3,338,217 | 8/1967 | Harrison . | |
| 3,373,509 | 3/1968 | Brass . | |
| 3,526,006 | 9/1970 | Beardmore . | |
| 3,972,628 | 8/1976 | Stevers . | |
| 4,037,975 | 7/1977 | Huffman . | |
| 4,095,906 | 6/1978 | Sackett | 401/48 |
| 4,111,566 | 9/1978 | Kenwell . | |
| 4,312,130 | 1/1982 | Reiff | 401/48 X |
| 4,511,272 | 4/1985 | Brown et al. . | |
| 4,906,119 | 3/1990 | Hartford . | |
| 4,917,517 | 4/1990 | Ertz . | |
| 4,944,766 | 7/1990 | Williams . | |
| 4,957,442 | 9/1990 | Prater . | |

FOREIGN PATENT DOCUMENTS

| | | | |
|---|---|---|---|
| 76124 | 3/1918 | Austria | 401/48 |
| 300421 | 1/1916 | Germany | 15/437 |

OTHER PUBLICATIONS

The Arthritis Foundation, "Guide to Independent Living for People with Arthritis", (1988).

AliMed, Inc., "Office Computer & Industrial Ergonomics", (1993).

*Primary Examiner*—Steven A. Bratlie

*Attorney, Agent, or Firm*—Ratner & Prestia

[57] ABSTRACT

A hand writing device for assisting the young, old, and disabled to impart indicia onto a medium. The device includes an ergonomically designed and anthropomorphically shaped body having a top adapted to accommodate the palm of the hand, a planar bottom, and a reservoir containing a supply of writing fluid. A stylus is provided with a tip for depositing the writing fluid on the medium. A glide system is positioned on the bottom of the body and is adapted to provide low-friction movement of the device over the medium. The device pivots between a first position engaging the stylus with the medium and a second position disengaging the stylus from the medium. A head is coextensively connected to and extends outwardly from one end of the body and holds the stylus. The device allows the user to transfer writing motion between the hand and the stylus without having to grasp, grip, hold, or exercise finger control.

5 Claims, 9 Drawing Sheets

HAND WRITING DEVICE

FIELD OF THE INVENTION

This invention relates generally to devices which assist persons with disabilities—rendering them unable to use their fingers to grasp a conventional, linear writing implement like a pen or pencil—to handwrite. More particularly, the invention relates to a hand writing device for which the user imparts motion and control (hence, precision) through the palm (which contacts the device) and the wrist, elbow, and shoulder (which generate motion).

BACKGROUND OF THE INVENTION

Various physical infirmities, illnesses, disabilities, and age are known to affect the ability of many individuals to write with a conventional, linear writing instrument. For example, younger people, whose hands and coordination are not yet fully developed, often find it very difficult to hold or move a conventional writing instrument across paper. Older people, whose hands may suffer from a malady like arthritis or whose coordination may falter, experience similar difficulties. Still others have disabilities (like cerebral palsy, Alzheimers, Parkinson disease, and other neurological dysfunctions) which cause the writer's hand to pulse and tremble uncontrollably—making written words difficult to create. In still other cases, people are missing digits and cannot grasp a conventional, linear, writing implement like a pen, crayon, chalk, or pencil.

In each of these classes of people, the writer is frustrated by the inability to write efficiently and accurately even a simple letter. Such frustration may undermine self esteem. Moreover, the writer may become isolated from friends and society because written communication may be virtually impossible. Many employment opportunities may be beyond reach; jobs often require writing skills and preclude spending an inordinate amount of time and effort on the task of writing.

Accordingly, many attempts have been made in the past to provide devices which would enable the user to more efficiently and legibly write with a steady and evenly controlled writing motion. A majority of these devices require the user to grip the conventional writing instrument, typically a pen or pencil, and include a bearing surface for movement across the paper. Such devices are unsuccessful because many of the physically challenged people mentioned above cannot hold a pen or pencil and apply the required pressure to write.

Other known devices provide a relatively large rollable or slidable support designed to be grasped by the entire hand. Many people cannot grasp the support—even with the entire hand. Moreover, these devices require that the conventional writing instrument either be held by the fingers, a requirement beyond the abilities of many, or affixed to the device, a requirement which makes it difficult to maintain sufficient control and pressure to write.

More specifically, U.S. Pat. No. 4,111,566 (issued to Kenwell) discloses a travelling hand support for aiding the handicapped to write. The support has a body and a head cantilevered from the body for holding a conventional writing instrument (e.g., pen or pencil). A chamber is provided in the body to hold extra pens. The bottom of the body is beveled so that the support can be tipped easily about a pivot point. Once tipped, the support automatically applies the pressure necessary for writing without adjustment and without requiring finger or arm movement.

U.S. Pat. No. 4,906,119 (issued to Hartford et al.) discloses a handwriting stabilizer used to steady the hand while writing. The stabilizer includes an ergonomically shaped body, able to adjust automatically to either a right or left hand, and a bore. On one end of the ink cartridge, which is placed in the bore and is disposables is a writing point. The writing point can be retracted into the bore when the stabilizer is not in use. A glide bump is provided on the bottom of the stabilizer, in the plane of the writing point, to allow the stabilizer to traverse the writing surface. The glide bump may include a ball bearing. A cap may be placed over the writing point to prevent the point from drying or marking when not in use.

The combined hand support and writing instrument holder of U.S. Pat. No. 4,917,517 (issued to Ertz) has a contoured body fabricated from a light-weight, easily molded material such as plastic, polyester resin, or the like. The contoured body corresponds to the dimensions of the average hand and is symmetrical to accommodate both right and left-handed users. The rear of the body functions as a wrist support and the head of the body holds a conventional writing instrument. The bottom of the body has a planar surface, which allows the user to slide the body along the writing surface, and a pivot point, which allows the user to rock the body and relocate the writing instrument.

U.S. Pat. No. 4,511,272 (issued to Brown et al.) discloses a writing prosthesis including a base secured to the user's forearm. That base supports the wrist. A head portion of the base holds a conventional writing instrument. A glide system, formed by wheels or rollers which contact the writing surface, is provided. The user starts and ends characters by rocking the base about a pivot point or fulcrum and controls the prosthesis by applying only the residual proximal muscles.

In summary, although many devices are designed to help the young, old, and disabled, they focus on improving the ability to grasp conventional writing implements using the fingers. There remains a need, therefore, for a hand writing device which focuses on improving the control and transfer of motion between the hand and the stylus without reliance on grasping, gripping, holding, or finger control.

SUMMARY OF THE INVENTION

To achieve these and other objects, and in view of its purposes, the present invention provides a hand writing device for assisting the young, old, and disabled to impart indicia onto a medium, The device includes an ergonomically designed and anthropomorphically shaped body having a top adapted to accommodate the palm of the hand, a planar bottom, and a reservoir containing a supply of writing fluid. A stylus is provided with a tip for depositing the writing fluid on the medium. A glide system is positioned on the bottom of the body and is adapted to provide low-friction movement of the device over the medium. The device pivots between a first position engaging the stylus with the medium and a second position disengaging the stylus from the medium. A head is coextensively connected to and extends outwardly from one end of the body and holds the stylus. The device allows the user to transfer writing motion between the hand and the stylus without having to grasp, grip, hold, or exercise finger control.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

DETAILED DESCRIPTION OF THE INVENTION

Figure 1:
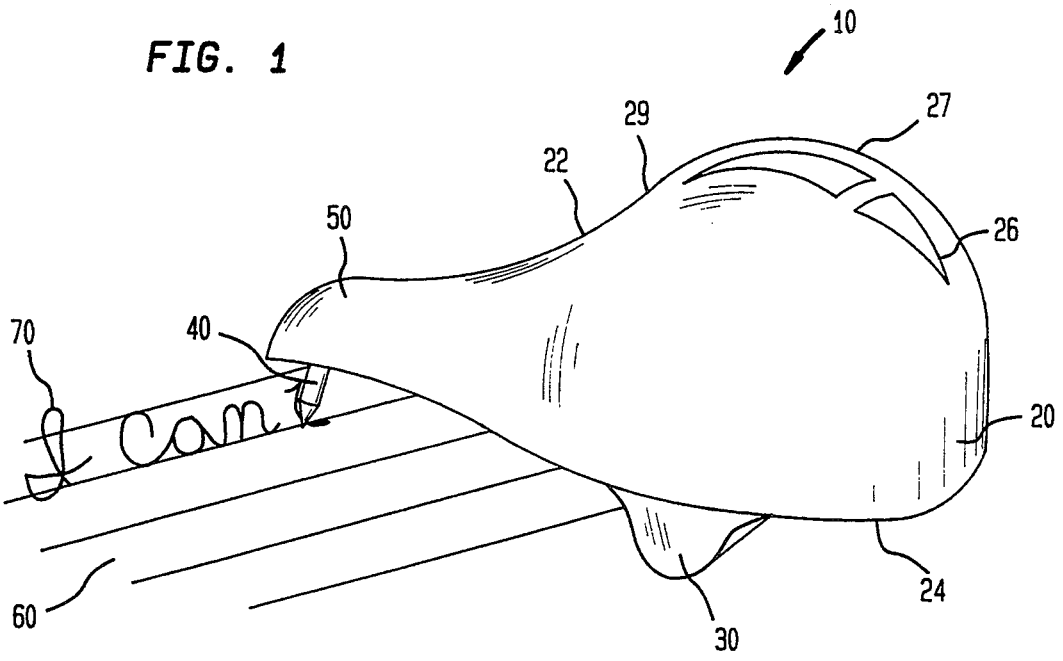
FIG. 1 is a perspective view of a hand writing device in accordance with the present invention.
Figure 2:
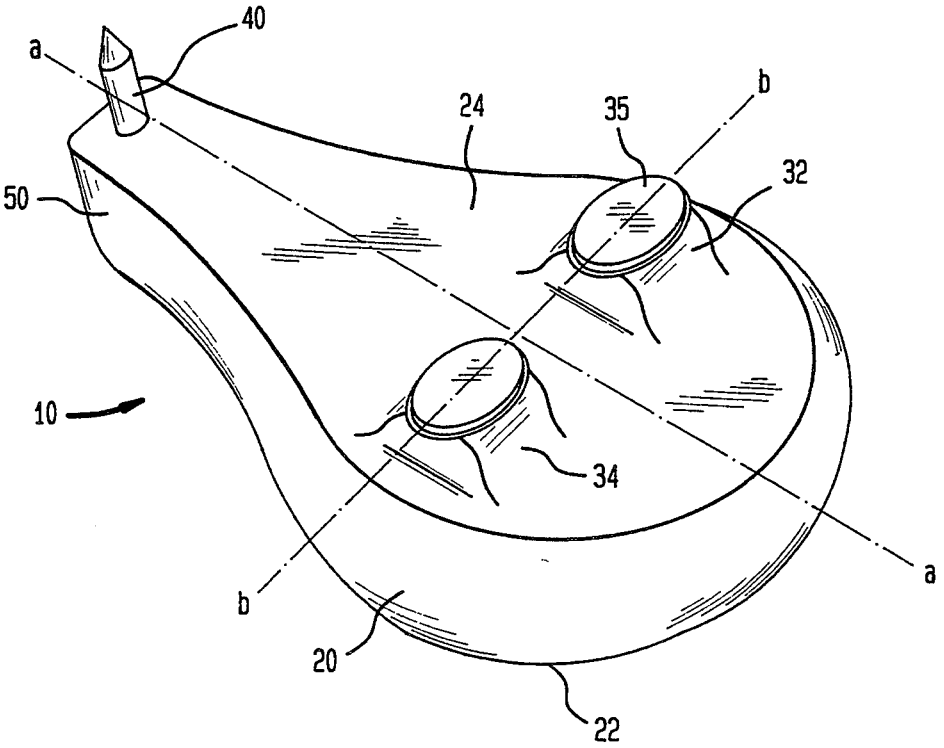
FIG. 2 is a perspective view of the hand writing device shown in FIG. 1 turned upside down.

Referring now to the drawing, wherein like reference numerals refer to like elements throughout, FIGS. 1 and 2 show perspective views (FIG. 1 from the top; FIG. 2 from the bottom) of a hand writing device 10 in accordance with the present invention. Device 10 has four, main elements: a body 20, a glide system 30, a stylus 40, and a head 50. Device 10 contacts medium 60, such as a sheet of paper, imparting indicia 70, such as writing, printing, or the like, onto medium 60.

Body 20 of device 10 is ergonomically designed and anthropomorphically shaped to meet the specific needs of the individual user. Body 20 has a suitable length and width which corresponds to the dimensions of the average hand. The top 22 of body 20 shown in FIGS. 1 and 2 is contoured to accommodate the palm of the hand and to maximize manual control of device 10. Top 22 of body 20 is contoured to be symmetrical about the longitudinal axis, a, of device 10 so that body 20 is equally accessible to both right and left-handed users.

Body 20 may be composed of a transparent material to assure that the user can view medium 60 and indicia 70. For aesthetic purposes, body 20 may be colored, tinted, or provided with a design (such as a racing stripe 26). A functional designation, such as an arrow on body 20 aligned with stylus 40 to allow the user to locate the position of stylus 40 quickly when writing, is also possible. Body 20 is preferably fabricated from a lightweight, easily molded material such as plastic or the like.

Figure 3:
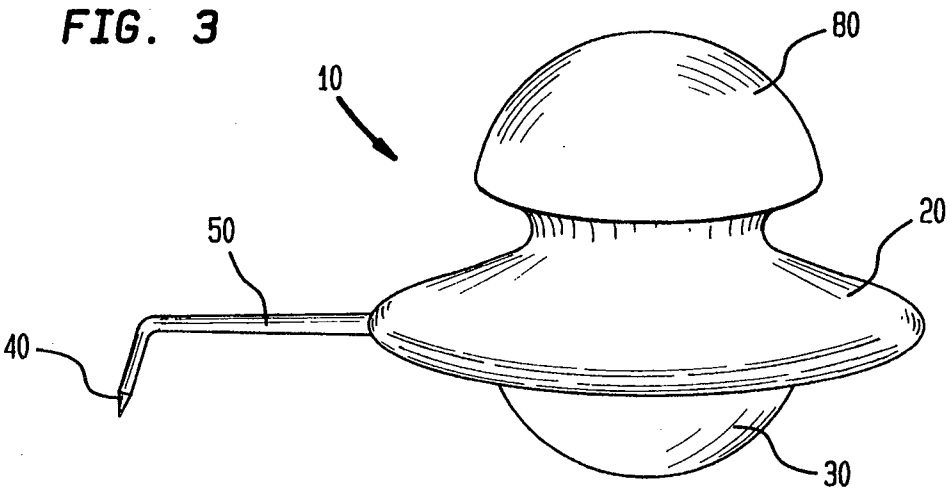
FIG. 3 illustrates a hand writing device of the present invention having a dome-shaped knob on its body.

As shown in FIGS. 1 and 2, body 20 has a pear shape. FIG. 3 illustrates device 10 having an alternative, spherical, dome-shaped knob 80 dimensioned to fit an average hand. Knob 80 is preferably integrally formed (e.g., molded) with body 20. Like pear-shaped body 20 shown in FIGS. 1 and 2, knob 80 of body 20 shown in FIG. 3 is symmetric for use with either the right or left hand.

Figure 4:
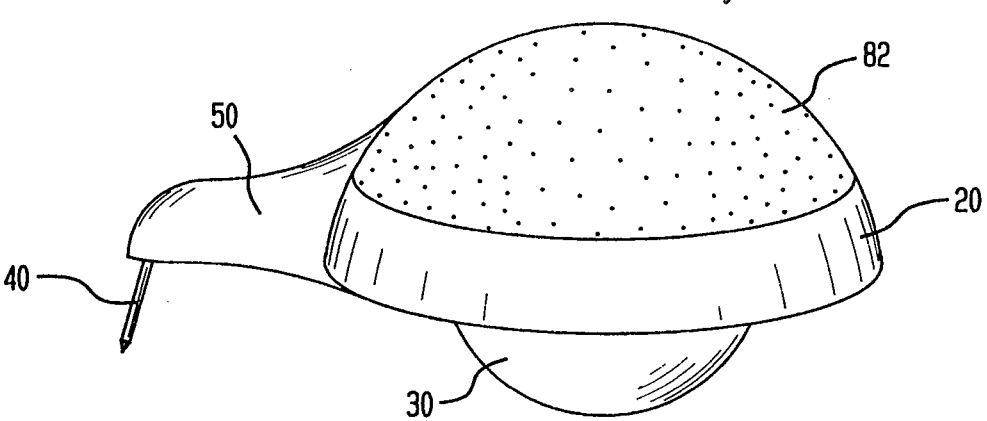
FIG. 4 illustrates the body of the hand writing device of the present invention having a textured contact surface.

The surface of body 20 which contacts the hand of the user may be provided with a textured contact surface 82. FIG. 4 illustrates body 20 having textured contact surface 82. Ribs 84 (see FIG. 5) also may be provided on body 20 for better contact.

Figure 5:
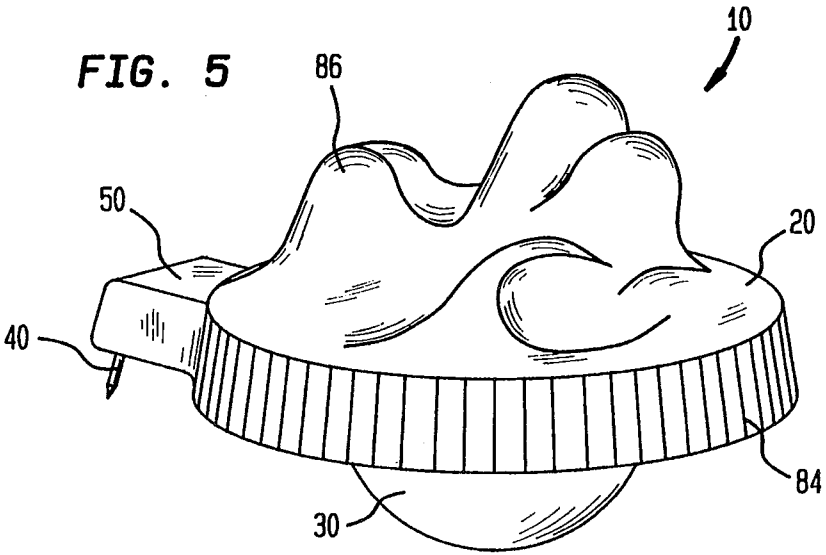
FIG. 5 illustrates the body of a hand writing device of the present invention having contours which are molded to precisely fit the individual user's hand.

As shown in FIG. 5, a cast might be taken of the user's hand and body 20 molded from the cast. Contours 86 then will precisely fit the individual user's hand. If so molded, device 10 might require a prescription or function as a prosthesis.

Often an individual is unable even to cup the hand to contact a contoured top 22 of body 20 of device 10. In addition, individuals normally able to exert such contact may be unable to do so temporarily. Surgery, joint inflammation, or other condition of soreness may render contact painful. Top 22 of body 22 may be provided with a flexible pouch 88 to accommodate these individuals.

Figure 6:
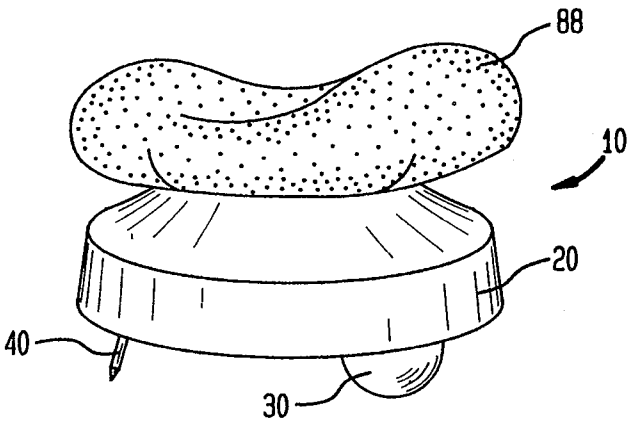
FIG. 6 illustrates the body of a hand writing device of the present invention having a flexible pouch which will adjust automatically to the shape of the user's hand.

As shown in FIG. 6, pouch 88 will adjust automatically to the shape of the user's hand. Pouch 88 provides a soft, comfortable contact surface. The material which fills pouch 88 may be a fluid such as gelatine, water, or the like. Beads, rubber, or foam would also be a suitable filler material.

Figure 8:
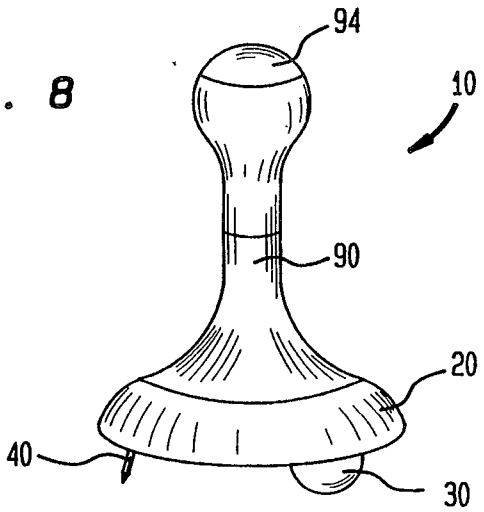
FIG. 8 shows a post member extending vertically upward and centrally from the body of a hand writing device of the present invention, the post member having a bulbous member.
Figure 7:
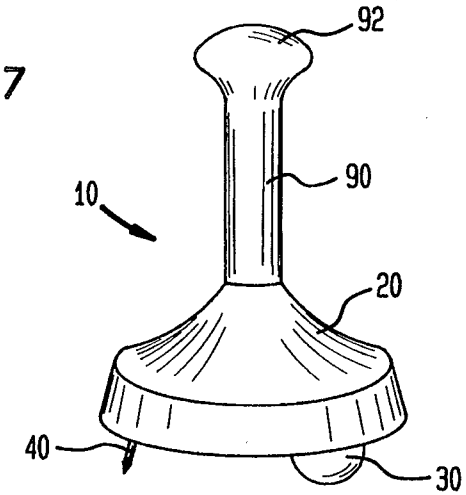
FIG. 7 shows a post member extending vertically upward and centrally from the body of a hand writing device of the present invention, the post member having a crown.

Some individuals may be unable to position their hands approximately horizontally; their writing hand may be more useful in a vertical position. Victims of palsy often fall within this group of individuals. The present invention meets the needs of these individuals by providing a post member 90 which may be moved by a vertically positioned hand. As shown in FIGS. 7 and 8, post member 90 extends vertically upward (but not necessarily perpendicularly) and centrally from body 20. Although it may be tubular or a solid piece, in either case post member 90 may be either flexible or rigid. Post member 90 may be detachably connected to body 20 or, preferably, molded integrally with body 20. Post member 90 may be made of the same material used to construct body 20 and is shaped to conform with the user's palm and to provide a contact surface.

As shown in FIG. 7, a crown 92 is mounted on the top of post member 90. Alternatively, a bulbous member 94 may be mounted on the top of post member 90. Post member 90 extends approximately diametrically through either crown 92 or bulbous member 94. Crown 92 and bulbous member 94 are shaped to fit readily in the crevice (or the base of that crevice) between the thumb and forefingers of an individual, with the palm contacting post member 90.

The choice between crown 92 and bulbous member 94 depends upon the user's ability to contact post member 90 comfortably at a near vertical position (crown 92 is preferable) or at a position at some angle from the vertical (bulbous member 94 is preferable, with the spherical shape of bulbous member 94 selected to accommodate the angle). The height of post member 90 is selected to conform to the individual user.

Figure 9:
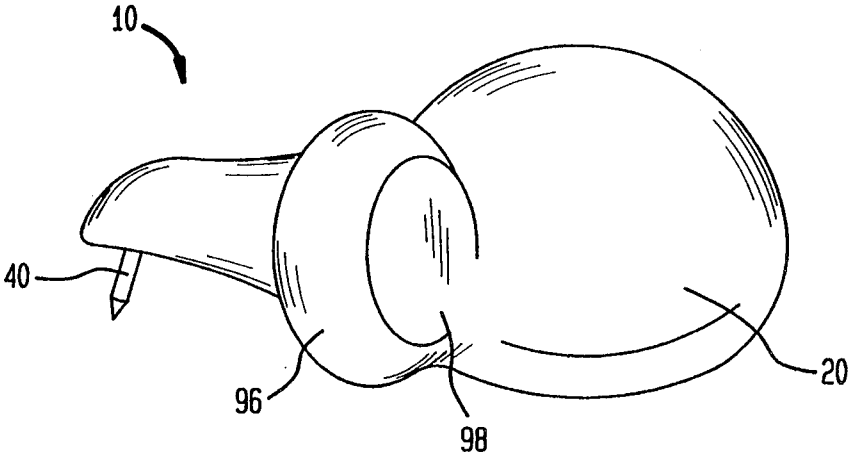
FIG. 9 shows a thumb or finger ring provided on the side of the body of a hand writing device of the present invention.

Should the user be able to use a thumb or finger, a thumb or finger ring 96 may be provided on the side of body 20 for additional control. As shown in FIG. 9, ring 96 may be integrally formed (e.g., molded) along with body 20. The thumb or finger is inserted into the aperture 98 of ring 96 alongside body 20 when the palm of the hand contacts body 20. Ring 96 allows the user to exert increased control over the movement of device 10.

Figure 10:
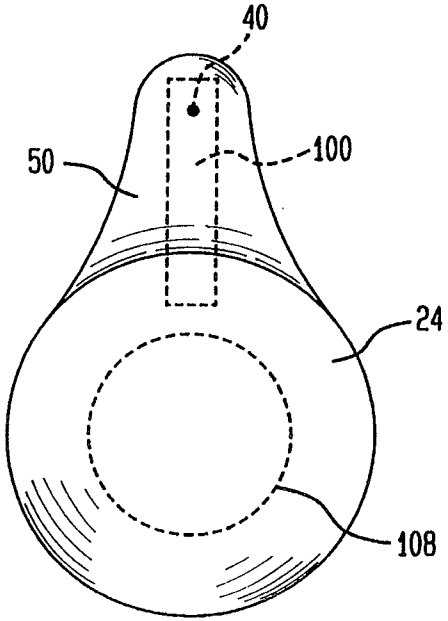
FIG. 10 is a bottom view of a hand writing device of the present invention having a writing fluid reservoir and a rolling ball glide system.
Figure 11:
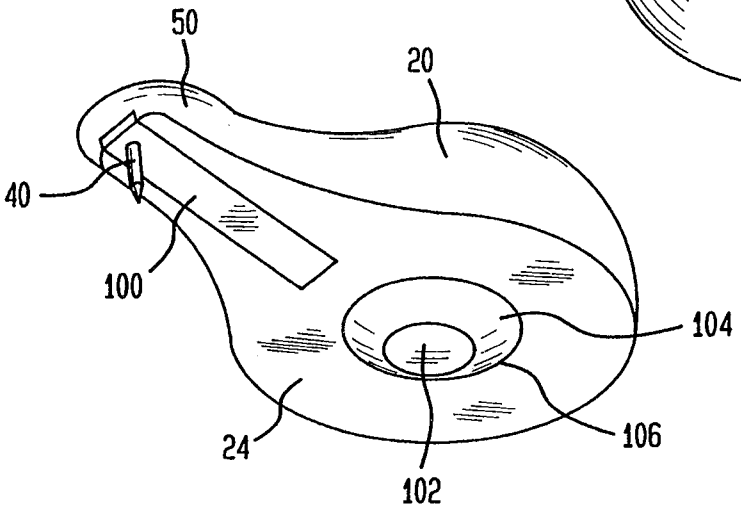
FIG. 11 is a perspective view from the bottom of the hand writing device shown in FIG. 10.
Figure 13:
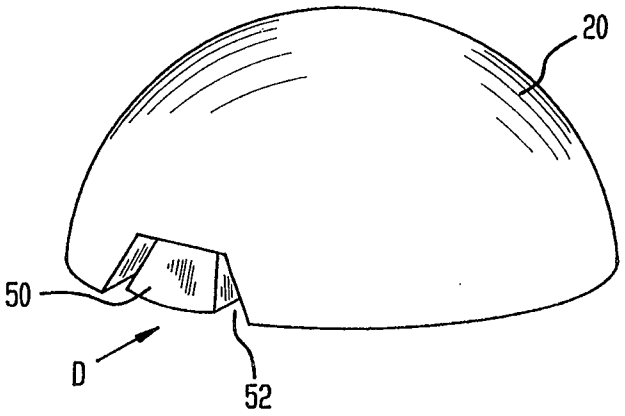
FIG. 13 is a perspective view of the hand writing device shown in FIG. 12 with the head retracted.

As shown in FIGS. 10 and 11, body 20 may have a reservoir 100 containing a supply of writing fluid (e.g., an ink). The supply of writing fluid in reservoir 100 may be replenished. If so, stylus 40 may be made disposable and replaceable. Alternatively, stylus 40 and reservoir 100 may form together a disposable and replaceable cartridge unit. The ease with which device 10 may be manufactured and the relatively inexpensive components incorporated in device 10 also permit device 10 to be discarded and replaced once the writing fluid in reservoir 100 is depleted.

As shown in FIG. 2, a glide system 30 is positioned on the planar bottom 24 of body 20 to provide low-friction movement of device 10 over medium 60. Glide system 30 may include a Teflon®-like surface treatment, a low-friction molded material (for example, high density polyethylene), ball bearings, a roller ball, or the like. The primary requirement for glide system 30 is that it provide a smooth surface allowing contact between device 10 and medium 60 with minimum friction as device 10 moves over medium 60.

Glide system 30 having two legs 32, 34 is suitable (see FIG. 2). Legs 32, 34 and stylus 40 form a planar, three-point (tripod or triangular) contact with medium 60. Each of legs 32, 34 is identical and is spaced opposite the other adjacent the periphery of body 20 and at an equal distance from longitudinal axis a. Stylus 40 forms the third point of the three-point contact system and lies at the apex of an isosceles triangle with legs 32, 34 forming the opposite corners. Legs 32, 34 are positioned to provide a fulcrum so that a slight rocking motion raises and lowers stylus 40 as letters and words are generated. Therefore, there is no need to grasp or lift the device.

Specifically, legs 32, 34 lie on an imaginary pivot line, b (see FIG. 2), about which device 10 pivots. When writing with device 10, the user may rock body 20 about pivot line b, by exerting pressure between the palm and top 22 of body 20, to easily engage and disengage stylus 40 with and from medium 60. Device 10 also allows the user's hand to rest while holding device 10 on pivot line b. When the user exerts pressure on top 22 at a rearward point 27 (FIG. 1), body 22 pivots clockwise about pivot line b and rocks backward—disengaging stylus 40 from medium 60. In contrast, when the user exerts pressure on top 22 at a forward point 29 (FIG. 1), body 22 pivots counterclockwise about pivot line b and rocks forward—engaging stylus 40 with medium 60.

Each of legs 32, 34 may be formed integrally with body 20. If so, legs 32, 34 may be constructed (e.g., molded) of the same material as body 20. To enhance the sliding characteristics of legs 32, 34, a Teflon® (or other frictionless) coating 35 may be applied to the bottoms of legs 32, 34. Legs 32, 34 also may be molded using a low-friction material.

Alternatively, an anti-friction bearing, such as a ball bearing 36 (FIG. 14), may be rotatably mounted in the bottom end of each leg 32, 34. Ball bearings 36 are captively held in sockets 38 in the ends of legs 32, 34 and are freely rotatable in all directions. Ball bearings 36 permit device 10 to be manipulated readily in any desired direction on medium 60 without scratching or marring medium 60.

Another alternative glide system 30 is shown in FIGS. 10 and 11. Roller ball 102 is provided centrally on bottom 24 of body 20. A standard ball bearing race, generally indicated at 104, and an annular ball retainer 106 hold roller ball 102 in place. The advantage of roller ball 102 is that it enables a full, universal movement of device 10 in the plane of medium 60; there is no resistance to movement in any direction. Moreover, friction is minimized so that, in use, roller ball 102 offers no noticeable resistance even to minor movements of device 10.

Roller ball 102 allows the user to rock device 10 in any direction from the vertical and without any tendency to assume any one displaced position. Thus, device 10 having roller ball 102 as glide system 30 is sensitive to slight tilting pressures—allowing the user to shade or stop writing by rocking device 10 about its own axis.

A stylus 40 is provided with device 10. Stylus 40 is itself part of the invention. Thus, device 10 is not designed for use with existing, linear, writing implements and, therefore, avoids the necessity of gripping, grasping, or holding such implements. Stylus 40 may have a fiber tip 42 which deposits writing fluid onto medium 60. Stylus 40 deposits writing fluid without requiring hand pressure. As shown in FIG. 10, body 20 may be provided with an inner chamber 108 suitable for storage of extra styluses 40, reservoirs 100, or other objects.

As shown, for example, in FIGS. 1 and 2, head 50 may be integrally provided on (coextensively connected to and extending outwardly from one end of) body 20 for holding writing stylus 40. Thus, head 50 may be a forward extension of body 20. Although entire device 10 (including stylus 40 and reservoir 100) may be made disposable, stylus 40 alone (or the combination of stylus 40 and reservoir 100 alone) might be made a disposable component of an otherwise reusable device 10. A design having a disposable stylus 40 and reservoir 100 is preferable because it gives device 10 the flexibility of interchangeable styluses 40 and reservoirs 100 of different colors and stylus tip 42 diameters.

Figure 12:
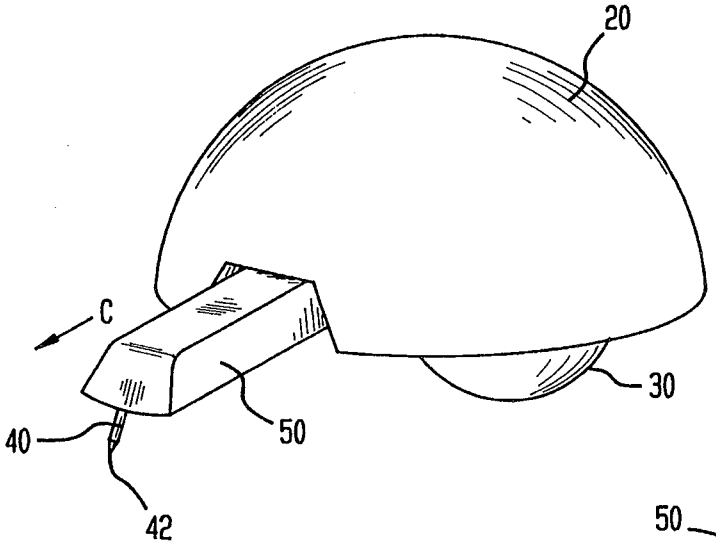
FIG. 12 is a perspective view of a hand writing device according to the present invention showing a retractable head in the extended position.
Figure 14:
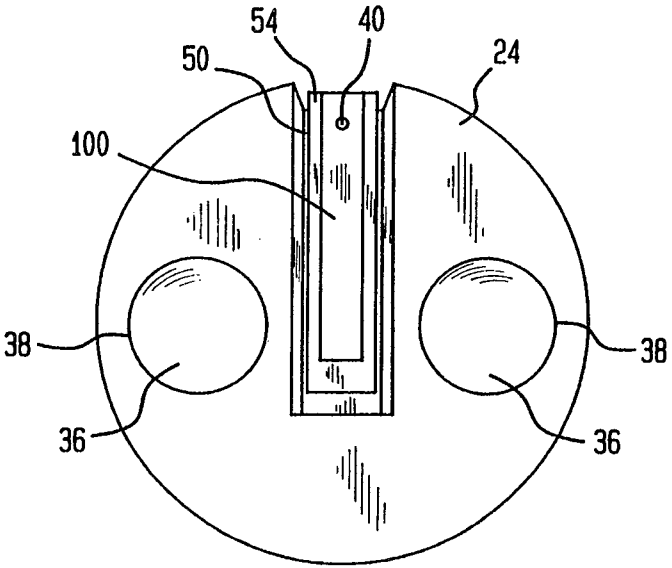
FIG. 14 is a bottom view of the hand writing device shown in FIG. 13.

As shown in FIGS. 12–15, head 50 may be made retractable into body 20 for protection of stylus 40 during storage and transportation. FIG. 12 illustrates head 50 in the extended position, head 50 having been extended in the direction of arrow C, ready for writing. When head 50 is pushed toward body 20 in the direction of arrow D in FIG. 13, head 50 is retracted into slot 52 in body 20. FIG. 14 illustrates, in a bottom view, head 50 in the fully retracted position inside body 20.

Head 50 may be locked in the fully retracted position by a flexible, U-shaped retaining pin 54. Essentially, head 50 snaps into and out of engagement with retaining pin 54. A pin, a spring, or other suitable mechanism could also be used to lock head 50 in the fully retracted position. For additional protection, stylus 40 may fold up against the bottom of head 50 (or itself retract into head 50) before head 50 is retracted. The retraction feature allows device 10 to be placed in a pocket or purse without fear that stylus tip 42 will inadvertently mark the pocket or purse.

Figure 15:
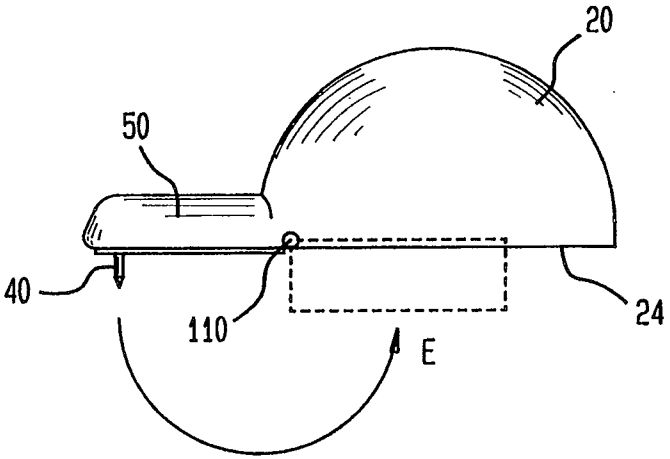
FIG. 15 is a side view of a hand writing device of the present invention having a foldable head.

Head 50 also may fold up against body 20 for storage and transportation. As shown in FIG. 15, head 50 folds, in the direction of arrow E and about pivot 110, against bottom 24 of body 20. A recess (not shown) in bottom 24 may be provided to receive either stylus 40 or the entire head 50 in the folded position.

Figure 16:
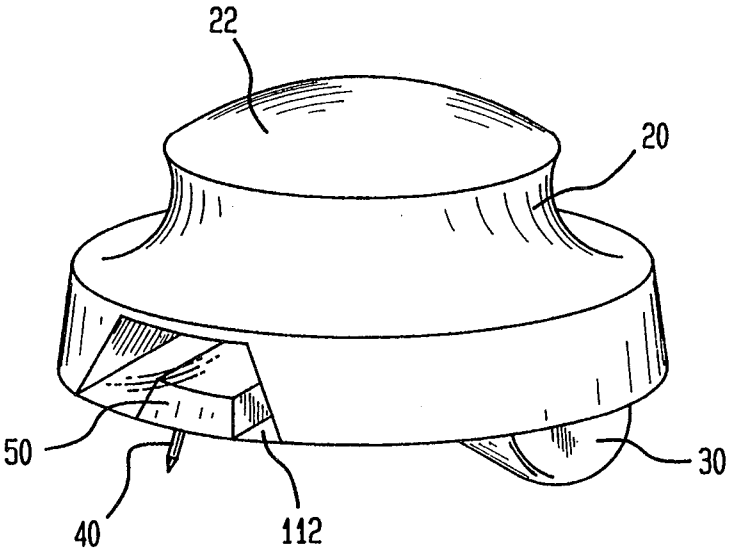
FIG. 16 shows a hand writing device of the present invention having a transparent portion.

As stated above, body 20 may be composed of a transparent material to assure that the user can view medium 60 and indicia 70. Alternatively, as shown in FIG. 16, body 20 may have a transparent portion 112—rather than being entirely transparent. Transparent portion 112 permits the user to view medium 60 and indicia 70 yet permits the non-transparent remainder of body 20 to be aesthetically colored, tinted, or provided with a design or designation.

Figure 18:
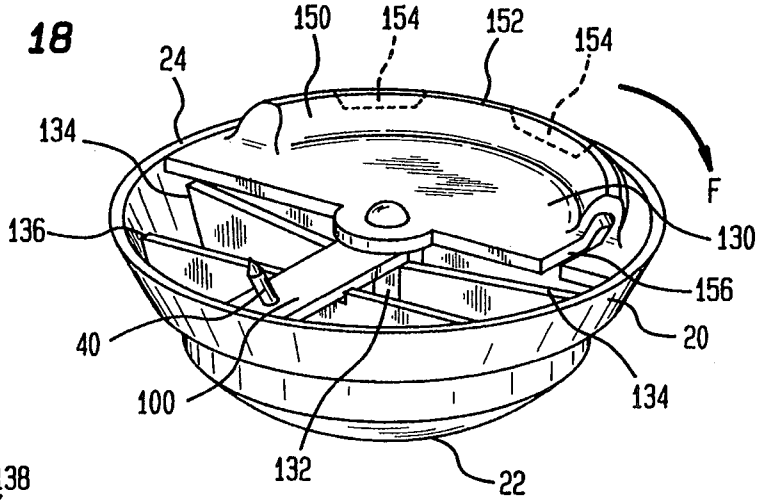
FIG. 18 is a perspective view from the bottom of the hand writing device shown in FIG. 17.
Figure 17:
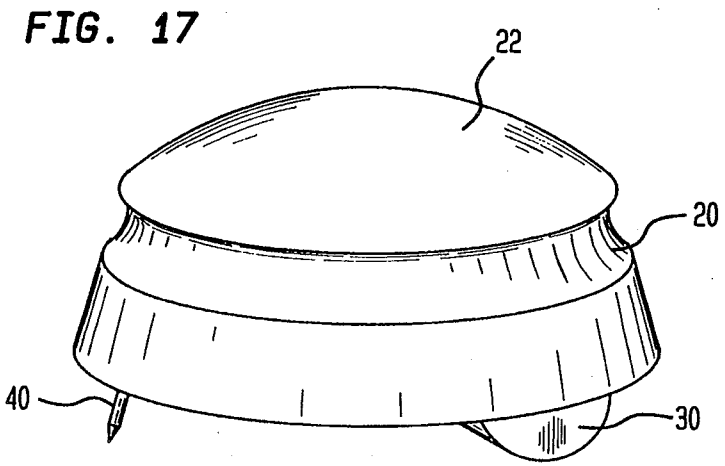
FIG. 17 is a perspective view of a hand writing device according to the present invention having a protective cover plate.
Figure 19:
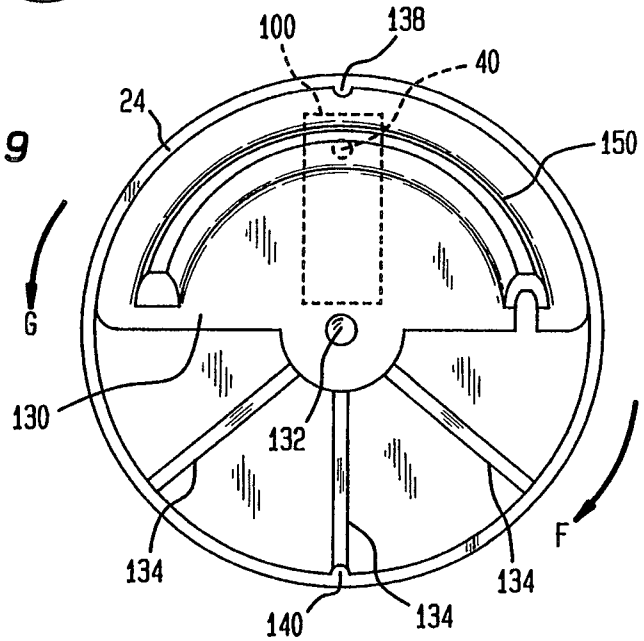
FIG. 19 is a bottom view of the hand writing device shown in FIGS. 17 and 18.

FIGS. 17–19 illustrate device 10 having a protective glide system 30. Glide system 30 has a substantially planar cover plate 130 which can be rotated about a center post 132. Center post 132 is fixed in position, approximately at the center of bottom 24 of body 20, by a multiplicity of radially extending struts 134. At least one wall 136 supports reservoir 100 in position inside body 20.

As shown in FIGS. 18 and 19, cover plate 130 can be rotated (in the direction of arrow F) between an open position (as shown in FIG. 18), exposing stylus 40, and a closed position (as shown in FIG. 19), which covers stylus 40 for transportation and protection of stylus 40 when it is not in use. A reverse rotation, in the direction of arrow G in FIG. 19, opens cover plate 130 and exposes stylus 40. A first stop 138, located adjacent stylus 40 on bottom 24 of body 20, engages cover plate 130 in the closed position and prevents further rotation of cover plate 130. Similarly, a second stop 140, located directly (180°) opposite first stop 138 on bottom 24 of body 20, engages cover plate 130 in the open position and prevents further rotation of cover plate 130.

Cover plate 130 is provided with a cover 150. As shown in FIGS. 18 and 19, cover 150 is a circular segment carried by cover plate 130 and has a hollow 156. When cover plate 130 is closed, cover 150 is positioned over stylus 40 with stylus 40 safely inside hollow 156 of cover 150. Thus, device 10 can be stored and transported without risk of damage to stylus 40 or of stylus tip 42 drying or marking inadvertently.

When cover plate 130 is opens cover 150 is positioned radially opposite stylus 40. Stylus 40 is exposed and able to contact medium 60. Moreover, cover 150 provides the surface 152 upon which device 10 glides over medium 60. As shown in FIGS. 18 and 19, surface 152 presents a relatively large contact area to medium 60. The friction between surface 152 and medium 60 can be reduced by providing a pair of cutouts 154 (shown in dashed lines in FIG. 18) in cover 150. Cutouts 154 reduce the contact area between cover 130 and medium 60.

Figure 20:
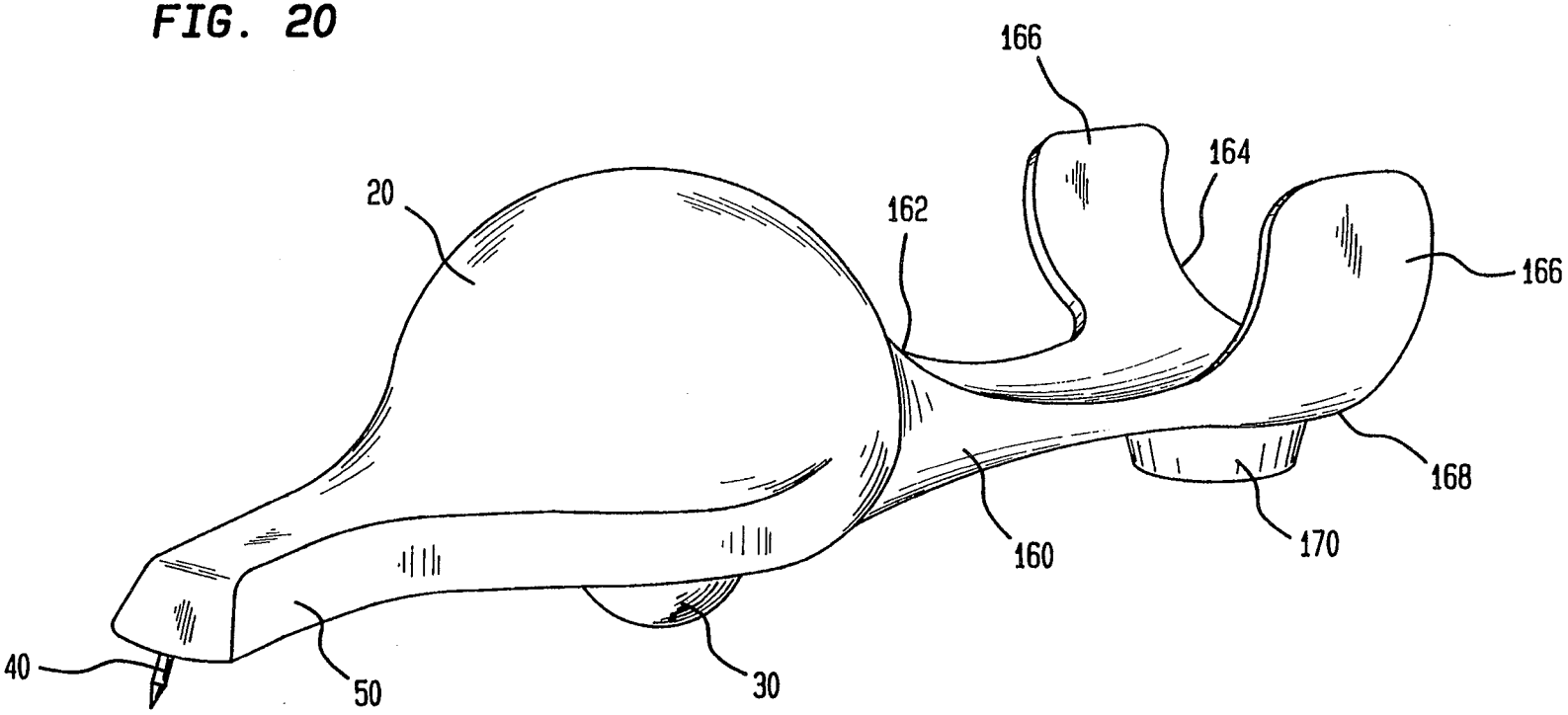
FIG. 20 is a perspective view of a hand writing device according to the present invention having a wrist support.

Turning to FIG. 20, a wrist support 160 may be provided as an additional element to more fully support the writer's hand and wrist and to provide added control. Wrist support 160 is coextensively connected to and extended outwardly from the end of body 20 opposite stylus 40. Thus, wrist support 160 is a rearward extension of body 20.

Intermediate portion 162 between body 20 and wrist support 160 is dimensioned and arranged to curve over the heel of the user's hand. Wrist support 160 is dimensioned and arranged to curve around the user's wrist and may extend to support the forearm.

Wrist support 160 is curved to form an upwardly turned rim 166 at its rear 164. Because it is suitably shaped to receive the user's wrist, wrist support 160 allows easy and accurate control of both lateral and rotational movement of device 10 relative to medium 60. By communicating both with body 20 and wrist support 160, the user is able to move device 10 precisely and to write indicia 70 with a steady, continuous motion that may be reliably and accurately controlled.

A glide 170 is provided on the bottom 168 of wrist support 160. Like glide system 30, glide 170 may be a leg or legs (with or without a Teflon®-like surface treatment), ball bearings, a roller ball, or the like. The primary requirement for glide 170, as for glide system 30, is that it provide a smooth surface allowing contact between wrist support 160 of device 10 and medium 60 with minimum friction as device 10 moves over medium 60.

Figure 21:
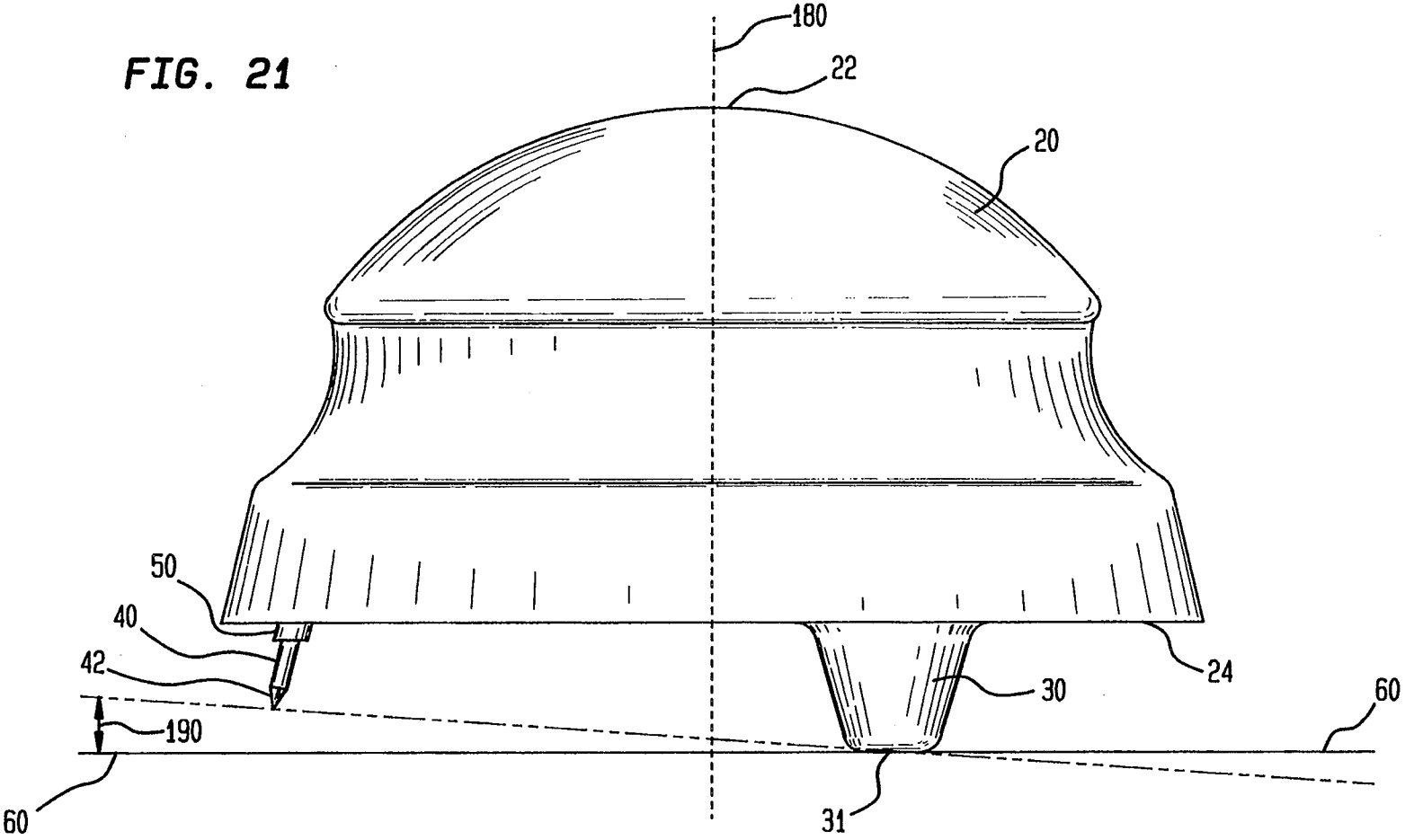
FIG. 21 is a perspective view of a hand writing device according to the present invention illustrating a stylus which is shorter than the legs of the glide system to facilitate a rocking motion.

FIG. 21 illustrates a geometric relationship between stylus 40 and glide system 30 which facilitates the slight rocking motion (discussed above) used to raise and lower stylus 40 as letters and words are generated. This rocking motion eliminates the need to grasp or lift the device. As shown in FIG. 21, stylus 40 may be shorter in length than glide system 30. Thus, stylus 40 extends downward below bottom 24 of body 20 a distance which is less than that by which glide system 30 extends downward below bottom 24. The difference in lengths between stylus 40 and glide system 30 creates a rocking angle 190. Rocking angle 190 may be adjusted by varying the relative lengths of stylus 40 and glide system 30 and the distance between stylus 40 and glide system 30.

Regardless of its distance from stylus 40, glide system 30 must be positioned behind center line 180 of body 20 to provide the desired rocking motion. In other words, glide system 30 is disposed on the opposite side of center line 180 from stylus 40. The ease of rocking also is influenced by the contact area between glide system 30 and medium 60° Accordingly, the bottom 31 of glide system 30 may be flat (creating a large contact area), as shown in FIG. 21, or curved.

Device 10 is compact and durable. It allows the user to write legibly without grasping, gripping, or holding any object whatsoever. Specifically, device 10 requires only that contact between the palm of the hand and device 10 which is assured by the downward pressure of the hand's own weight on device 10. Many people are unable to grasp, grip, or hold a conventional writing instrument, a writing aid, or any other object. The present invention alleviates that problem.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A hand writing device for assisting the young, old, and disabled to impart indicia onto a medium, said device having a longitudinal axis and comprising:

an ergonomically designed and anthropomorphically shaped body having a top adapted to accommodate the palm of the hand, a planar bottom, and a reservoir containing a supply of writing fluid;

a stylus having a tip depositing said writing fluid on the medium;

a glide system positioned on said bottom of said body and providing low-friction movement of said device over the medium, said glide system having a pair of legs spaced opposite each other adjacent the periphery of said body and equidistant from said longitudinal axis of said device, said legs and said stylus forming a planar, three-point contact with the medium and said legs being longer in length than said stylus to permit pivoting said device between a first position engaging said stylus with the medium and a second position disengaging said stylus from the medium; and a head coextensively connected to and extending outwardly from one end of said body and holding said stylus;

whereby writing motion is transferred between the hand and said stylus without reliance on finger control.

2. The hand writing device according to claim 1 wherein said body is symmetrical and has a length and a width corresponding to the dimensions of the average hand.

3. The hand writing device according to claim 1 wherein said body has a pear shape.

4. The hand writing device according to claim 1 wherein said stylus is disposable and replaceable.

5. The hand writing device according to claim 1 wherein each of said legs has a bottom and a frictionless coating on said bottom.

* * * * *